US009314682B2

(12) United States Patent
Baek et al.

(10) Patent No.: US 9,314,682 B2
(45) Date of Patent: Apr. 19, 2016

(54) RUNNING MACHINE

(75) Inventors: Ji-Yeon Baek, Yongin-si (KR); Won-Hoon Seo, Seoul (KR); Jun-Ho Kim, Seoul (KR); Do-Yong Sin, Gyeonggi-do (KR)

(73) Assignee: Samsung Display Co., Ltd., Yongin-si (KR)

( * ) Notice: Subject to any disclaimer, the term of this patent is extended or adjusted under 35 U.S.C. 154(b) by 761 days.

(21) Appl. No.: 13/619,660

(22) Filed: Sep. 14, 2012

(65) Prior Publication Data

US 2013/0244839 A1 Sep. 19, 2013

(30) Foreign Application Priority Data

Mar. 16, 2012 (KR) ..... 20-2012-0002124 U

(51) Int. Cl.

| | |
|---|---|
| ***A63B 19/04*** | (2006.01) |
| ***A63B 71/06*** | (2006.01) |
| ***A63B 69/00*** | (2006.01) |
| *A63B 22/02* | (2006.01) |

(52) U.S. Cl.

CPC ..... *A63B 69/0035* (2013.01); *A63B 19/04* (2013.01); *A63B 71/0622* (2013.01); *A63B 22/02* (2013.01); *A63B 2071/065* (2013.01); *A63B 2071/0638* (2013.01); *A63B 2071/0658* (2013.01); *A63B 2220/20* (2013.01); *A63B 2220/30* (2013.01); *A63B 2230/75* (2013.01)

(58) Field of Classification Search

CPC ..... A63B 69/0035; A63B 19/04; A63B 71/0622; A63B 22/02; A63B 2071/065; A63B 2071/0658; A63B 2071/0638; G03B 21/60

See application file for complete search history.

(56) References Cited

U.S. PATENT DOCUMENTS

| | | | | |
|---|---|---|---|---|
| 2,019,728 | A | 11/1935 | Ranck | |
| 2,953,394 | A | 9/1960 | Anderson | |
| 3,537,726 | A | 11/1970 | Conover | |
| 3,622,179 | A | 11/1971 | Pfersick | |
| 3,777,835 | A | 12/1973 | Bourne | |
| 3,779,201 | A | 12/1973 | Spahn | |
| 4,302,006 | A | 11/1981 | Johnson | |
| 5,792,031 | A | 8/1998 | Alton | |
| 6,074,305 | A | 6/2000 | Schnapp | |
| 6,500,097 | B1 | 12/2002 | Hall | |
| 6,740,009 | B1 | 5/2004 | Hall | |
| 7,834,944 | B2 * | 11/2010 | Otte et al. | 349/15 |
| D689,154 | S * | 9/2013 | Seo et al. | D21/669 |

(Continued)

FOREIGN PATENT DOCUMENTS

| | | | |
|---|---|---|---|
| KR | 20-0335975 | Y1 | 12/2003 |
| WO | WO 2005/030342 | A1 | 4/2005 |

OTHER PUBLICATIONS

U.S. Office action dated Feb. 7, 2013, for cross reference Design U.S. Appl. No. 29/419,169, (6 pages).

(Continued)

*Primary Examiner* — Christ Mahoney

(74) *Attorney, Agent, or Firm* — Lewis Roca Rothgerber Christie LLP

(57) ABSTRACT

A running machine including a hollow cylinder-shaped rotator having a diameter and including a wall having a constant thickness, a hollow cylinder-shaped display unit having a diameter greater than that of the rotator and encircling the rotator, and a support for supporting the rotator and the display unit in an upright state and for enabling rotation of the rotator about an axis of the rotator.

20 Claims, 4 Drawing Sheets

(56) References Cited

U.S. PATENT DOCUMENTS

| | | | | |
|---|---|---|---|---|
| 2002/0187880 | A1 | 12/2002 | Johnson | |
| 2004/0106504 | A1* | 6/2004 | Reiffel | 482/54 |
| 2004/0147369 | A1* | 7/2004 | Jimenez Laso | 482/8 |
| 2005/0233865 | A1 | 10/2005 | Reiffel | |
| 2006/0134583 | A1* | 6/2006 | Gonzalez de Mendoza y Kaeding | 434/55 |
| 2008/0141946 | A1 | 6/2008 | Kalani | |
| 2012/0010048 | A1* | 1/2012 | Bayerlein et al. | 482/2 |
| 2014/0179490 | A1* | 6/2014 | Schmitz et al. | 482/4 |

OTHER PUBLICATIONS

KIPO Office action dated Nov. 26, 2015, for Korean priority Patent application 20-2012-0002124, (6 pages).

* cited by examiner

RUNNING MACHINE

CROSS-REFERENCE TO RELATED APPLICATION

This application claims priority to and the benefit of Korean Patent Application No. 20-2012-0002124 filed in the Korean Intellectual Property Office on Mar. 16, 2012, the entire contents of which are incorporated herein by reference.

BACKGROUND (a) Field

An exemplary embodiment of the present invention relates to a running machine.

(b) Description of the Related Art

In general, a running machine is a device for enabling exercise in the form of walking or running in an in-door environment, and is designed for a user to walk or run on a belt that rotates due to a force provided by a motor.

Such a running machine requires that the speed of the belt be controlled in a manner corresponding to the physical condition and/or a desired exercise amount of the user. When the speed of the machine is manually controlled, the user manually controls the speed by running and controlling the speed at which the user runs. However, when the speed of the machine is automatically controlled/driven, a keypad is provided on a control panel of the machine to control the speed of the motor, thereby controlling the speed of the belt, and hence, the running speed.

However, aerobic exercise such as walking or running using a conventional running machine is performed by walking or running in place in an indoor space, and thus, the user may experience boredom before achieving an effective aerobic exercise, and accordingly, the user may be prone to prematurely quitting the exercise.

The above information disclosed in this Background section is only for enhancement of understanding of the background of the invention, and therefore may contain information that does not form the prior art that is already known in this country to a person of ordinary skill in the art.

SUMMARY

An exemplary embodiment of the present invention provides a running machine that can improve an exercise experience.

According to an exemplary embodiment of the present invention, there is provided a running machine including a hollow cylinder-shaped rotator having a diameter and including a wall having a constant thickness, a hollow cylinder-shaped display unit having a diameter greater than that of the rotator and encircling the rotator, and a support for supporting the rotator and the display unit in an upright state and for enabling rotation of the rotator about an axis of the rotator.

The rotator and the display unit may be integrally formed.

The rotator may include a transparent material, and the display unit and the rotator may be separated from each other.

The running machine may further include a pair of support rings respectively coupled to edges of a wall of the display unit to support the display unit, and the support rings may be configured to rotatably support the rotator.

The display unit may be configured to display an image on an interior of the display unit.

The display unit may include an organic light emitting element.

The support may be configured to rotate the rotator.

The rotator may include a transparent material, and the display unit and the rotator may be separated from each other.

The support may be at sides of the rotator while the rotator is in the upright state.

The support may include two triangularly-shaped sides and three rectangularly-shaped sides coupling the two triangularly-shaped sides to each other, one of the triangularly-shaped sides may contact the rotator, and one of the rectangularly-shaped sides may function as a base.

The running machine may further include at least one of an information display unit and a control panel at one of the rectangularly-shaped sides other than the base.

The control panel may be configured to control a rotation speed of the rotator or may be configured to control images displayed on the interior of the display unit.

The rotator may include a transparent material, and the display unit and the rotator may be separated from each other.

According to the exemplary embodiment of the present invention, the running machine can improve the exercise experience of the user.

DETAILED DESCRIPTION

Figure 1:
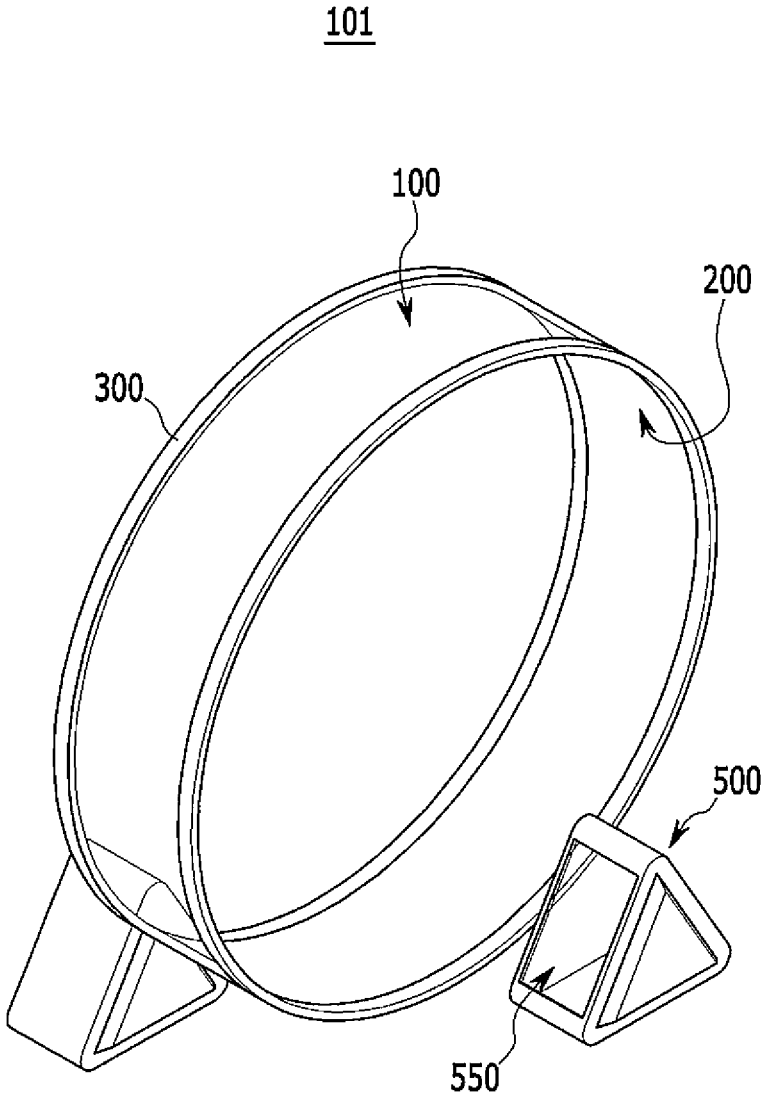
FIG. 1 is a perspective view of a running machine according to an exemplary embodiment of the present invention.

Embodiments of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

It shall be noted that the drawings are schematic and do not necessarily depict exact dimensions. The relative proportions and ratios of elements in the drawings may be exaggerated or diminished in size for the sake of clarity and/or convenience, and such arbitrary proportions are intended only to be illustrative, and are not intended to be limiting in any way. Like reference numerals are used for like structures, elements, or parts shown in two or more drawings to show similar characteristics. When one part is said to be "over" or "on" another part, the one part may be directly over the other part or may be accompanied by one or more other parts interposed therebetween.

The drawings specifically show exemplary embodiments of the present invention. As a result, various modifications of the drawings in accordance with the present invention are anticipated. Accordingly, exemplary embodiments are not limited to certain forms of the regions illustrated, but may include forms that are modified due to manufacturing, for example.

Hereinafter, a running machine 101 according to an exemplary embodiment of the present invention will be described with reference to FIG. 1 to FIG. 4.

Figure 2:
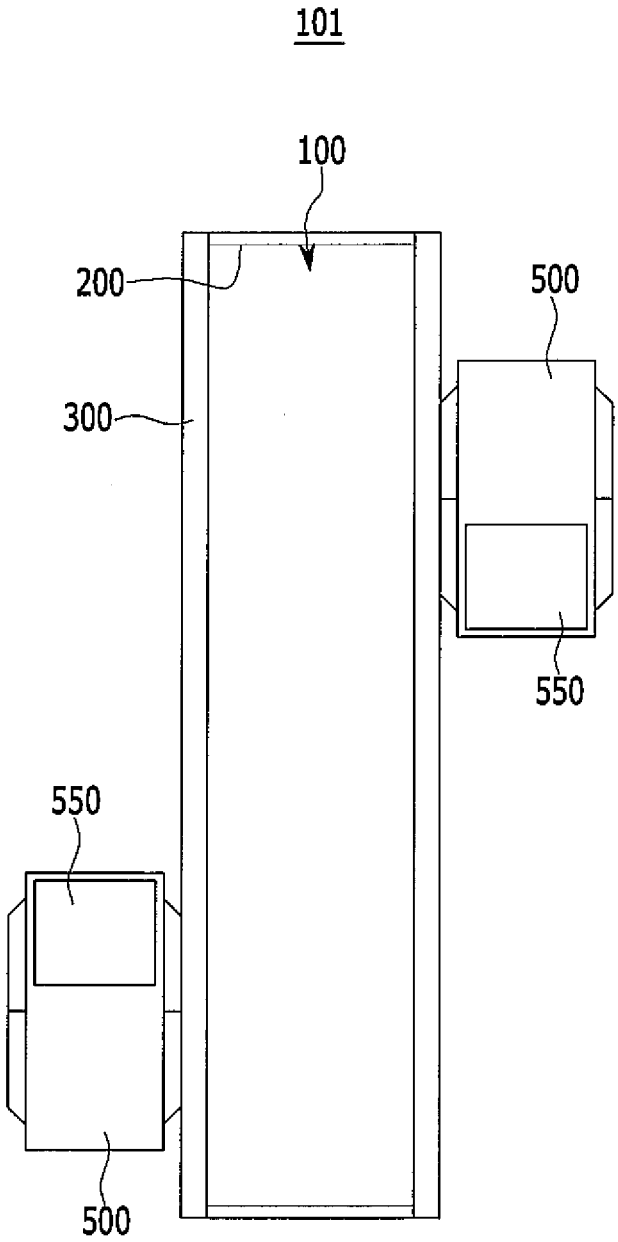
FIG. 2 is a top plan view of the running machine of the embodiment shown in FIG. 1.

As shown in FIG. 1 and FIG. 2, the running machine 101 according to the present exemplary embodiment includes a rotator 200, a display unit 100, and a support 500, which may include two or more individual supports.

The rotator 200 is in the shape of a hollow cylinder, which is set on the side of the cylinder when the rotator 200 is upright, and has a diameter that is greater than the height of an intended user, and also has a constant thickness (e.g., a width, or a geometric height of the cylinder). A user may walk or run on the running machine 101 by stepping on an interior of the rotator 200 with his foot (e.g., at a point higher than the lowest point of the rotator 200).

The rotator 200 of the present embodiment is formed of a transparent material. For example, the rotator 200 may be formed of glass or plastic.

Figure 3:
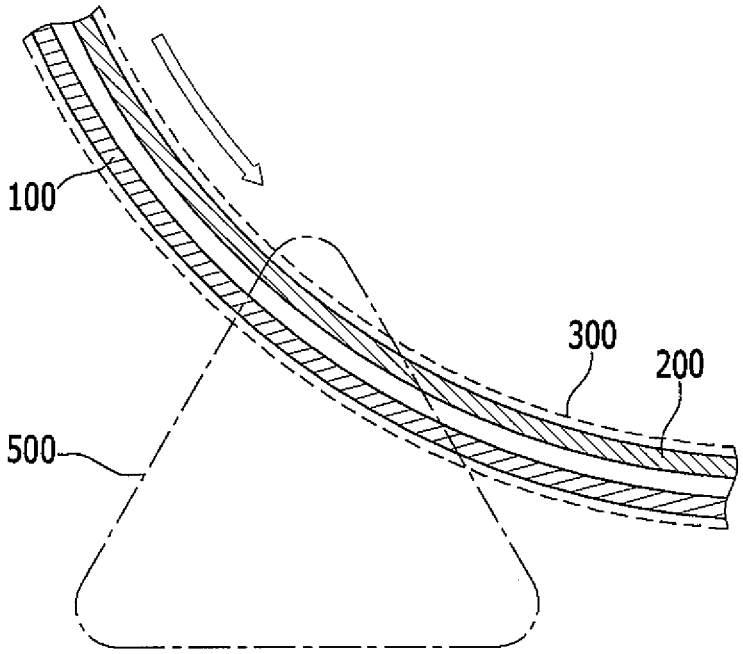
FIG. 3 is a partial cross-sectional view of the running machine of the embodiment shown in FIG. 1.

The display unit 100 is formed in the shape of a hollow cylinder corresponding to the shape of the rotator 200 (e.g., the display unit 100 may have a slightly larger inner diameter than an outer diameter of the rotator 200). In addition, the display unit 100 is arranged to overlap (e.g., encircle) the rotator 200 and to be positioned on an exterior of the rotator 200. That is, the interior circumference of the display unit 100 is located outside of the external circumference of the rotator 200. In addition, as shown in FIG. 3, the display unit 100 and the rotator 200 are spaced from each other.

The display unit 100 displays an image in a direction toward an interior of the cylinder that is the display unit 100. Further, the display unit 100 includes an organic light emitting element (e.g., a plurality of organic light emitting elements). That is, the display unit 100 may be a flexible organic light emitting diode display formed in the shape of a cylinder. The flexible organic light emitting diode display forming the display unit 100 may employ various known organic light emitting diode displays.

In addition, the running machine 101 may further include a pair of support rings 300 located at both edges of the rotator 200 and the display unit 100 to support the rotator 200 and the display unit 100. In the present embodiment, the pair of support rings 300 supports the rotator 200 to be rotatable (e.g., the rotator 200 is able to move with respect to the rings 300). In addition, the display unit 100 may be fixed by the pair of support rings 300 (e.g., fixed with respect to the support 500, in a non-rotatable state) rather than rotating along, or along with, the rotator 200.

Thus, the rotator 200 rotates according to motion (i.e., walking or running) of the user, and the display unit 100 may provide an image and/or image information to the user walking or running along the interior of the rotator 200. Furthermore, the rotator 200 functions as a surface for supporting the user, and also functions as a protection window to protect the display unit 100.

In further detail, the display unit 100 of the present embodiment can provide exercise information of the user such as, for example, walking or running speed, calories burned, distance traveled, etc. In addition, the display unit 100 can provide an image of a user-desired environment. That is, the display unit 100 may provide images selected by the user such as, for example, a forest park, an exotic street landscape, and/or other scenes found in nature, such that exercise experience of the user can be improved.

In FIG. 3, the running machine 101 of the present embodiment has a structure in which the rotator 200 and the display unit 100 are separated from each other, but the exemplary embodiment of the present invention is not limited thereto. Thus, the rotator 200 and the display unit 100 may be integrally formed. In this case, the display unit 100 rotates together with the rotator 200. In addition, the display unit 100 is driven to display an image in consideration of a rotation speed (e.g., the images displayed on the display unit 100 may be adjusted to produce an image that appears to be steady or stable with respect to the user despite the rotation of the display unit 100).

For rotation of the rotator 200, the support 500 supports the rotator 200 and the display unit 100 while putting them in an erected (e.g., upright) state. The support 500 may be at opposite sides of the rotator 200, and may be offset in a thickness or width direction of the rotator 200, or may be aligned on opposite sides of the rotator 200 in a rotation direction of the rotator 200. In addition, the support 500 may rotatably drive the rotator 200, and may do so using various devices and/or methods known to a person skilled in the art. For example, the support 500 can rotate the rotator with a motor roller.

The support 500 of the present embodiment is provided at both sides of the rotator 200 while the rotator 200 is in the erected (e.g., upright) state. The support 500 may be formed in the shape of a triangle or a triangular pyramid including two triangle-shaped sides and three square-shaped, or rectangularly-shaped, sides coupling the two triangle-shaped sides. In this case, one of the two triangular-shaped sides contacts the rotator 200, and one of the three squared-shaped sides may be a bottom side, or a base.

In addition, at least one of an information display unit and a control panel may be provided at another side of the third square-shaped sides in the support 500. The user may control a rotation speed of the rotator 200 through the control panel 550 of the support 500, and/or may select the type of image displayed in the display unit 100.

With such a configuration, the running machine 101 according to the exemplary embodiment of the present invention can improve the exercise experience of the user.

Hereinafter, operation of the running machine 101 provided on a table according to the exemplary embodiment of the present invention will be described with reference to FIG. 4.

Figure 4:
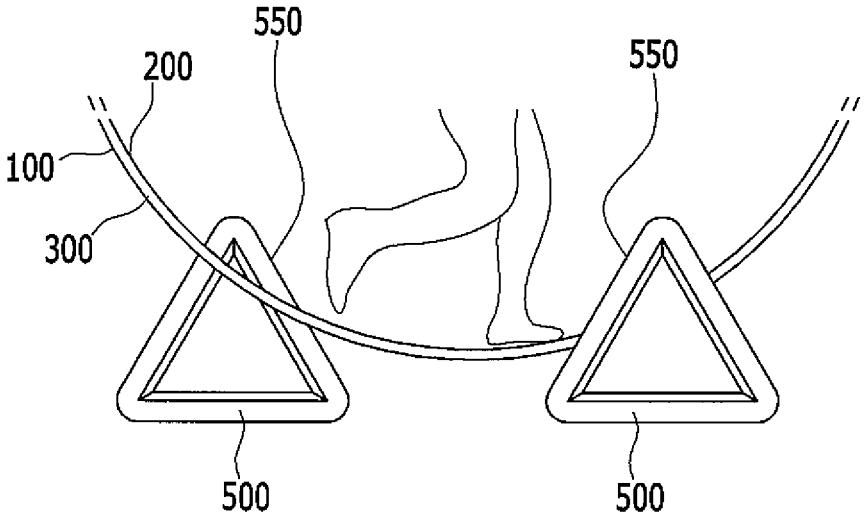
FIG. 4 is a side view of the running machine of the embodiment shown in FIG. 1 and legs of a user operating the running machine.

As shown in FIG. 4, the user stamps on, or steps on, the interior of the rotator 200 to walk or run. In this case, the user controls a rotation speed of the rotator 200 through the control panel 550 located in or on the support 500, and selects an image displayed in the display unit 100.

The display unit 100 provides images such as, for example, a forest park, an exotic street landscape, and/or other scenes in nature in accordance with a rotation speed of the rotator 200 to provide the user walking or running on the rotator 200 with a visual effect of walking or running outside. Accordingly, the user can expect an improved exercise experience.

While embodiments of the present invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and their equivalents.

Description of Some of the Reference Characters

| | |
|---|---|
| 100: display unit | 101: running machine |
| 200: rotator | 300: support ring |
| 500: support | 550: control panel |

What is claimed is:

1. A running machine comprising:

a hollow cylinder-shaped rotator having a diameter, and comprising a wall having a constant thickness;

a hollow cylinder-shaped display unit configured to emit light to display an image, the display unit having a diameter greater than that of the rotator and encircling the rotator; and a support configured to support the rotator and the display unit in an upright state and to enable rotation of the rotator about an axis of the rotator.

2. The running machine of claim 1, wherein the rotator and the display unit are integrally formed.

3. The running machine of claim 1, wherein the rotator comprises a transparent material, and wherein the display unit and the rotator are separated from each other.

4. The running machine of claim 1, wherein the display unit is configured to display an image on an interior of the display unit.

5. The running machine of claim 4, wherein the rotator and the display unit are integrally formed.

6. The running machine of claim 4, wherein the display unit comprises an organic light emitting element.

7. The running machine of claim 6, wherein the rotator and the display unit are integrally formed.

8. The running machine of claim 4, wherein the support is configured to rotate the rotator.

9. The running machine of claim 8, wherein the rotator and the display unit are integrally formed.

10. The running machine of claim 8, wherein the rotator comprises a transparent material, and wherein the display unit and the rotator are separated from each other.

11. The running machine of claim 8, wherein the support is at sides of the rotator while the rotator is in the upright state.

12. The running machine of claim 11, wherein the rotator and the display unit are integrally formed.

13. A running machine comprising:

a hollow cylinder-shaped rotator having a diameter, and comprising a wall having a constant thickness;

a hollow cylinder-shaped display unit having a diameter greater than that of the rotator and encircling the rotator;

a support for supporting the rotator and the display unit in an upright state and for enabling rotation of the rotator about an axis of the rotator; and a pair of support rings respectively coupled to edges of a wall of the display unit to support the display unit, wherein the support rings are configured to rotatably support the rotator.

14. A running machine comprising:

a hollow cylinder-shaped rotator having a diameter, and comprising a wall having a constant thickness;

a hollow cylinder-shaped display unit having a diameter greater than that of the rotator and encircling the rotator;

a support for supporting the rotator and the display unit in an upright state and for enabling rotation of the rotator about an axis of the rotator, the support comprising two triangularly-shaped sides and three rectangularly-shaped sides coupling the two triangularly-shaped sides to each other, wherein one of the triangularly-shaped sides contacts the rotator, and wherein one of the rectangularly-shaped sides functions as a base.

15. The running machine of claim 14, wherein the rotator and the display unit are integrally formed.

16. The running machine of claim 14, further comprising at least one of an information display unit and a control panel at one of the rectangularly-shaped sides other than the base.

17. The running machine of claim 16, wherein the rotator and the display unit are integrally formed.

18. The running machine of claim 16, wherein the control panel is configured to control a rotation speed of the rotator or is configured to control images displayed on the interior of the display unit.

19. The running machine of claim 18, wherein the rotator and the display unit are integrally formed.

20. The running machine of claim 18, wherein the rotator comprises a transparent material, and wherein the display unit and the rotator are separated from each other.

* * * * *